US005902969A

United States Patent [19]

Helpinen

[11] Patent Number: 5,902,969

[45] Date of Patent: May 11, 1999

[54] NOISE BARRIER

[75] Inventor: Harto Helpinen, Espoo, Finland

[73] Assignee: Arkkitehtuuritoimisto Harto Helpinen Ky, Espoo, Finland

[21] Appl. No.: 08/913,192

[22] Filed: Sep. 15, 1997

[30] Foreign Application Priority Data

Mar. 15, 1995 [FI] Finland ..... 951202

[51] Int. Cl.[6] ..... G10K 11/00; E04B 1/82

[52] U.S. Cl. ..... 181/210; 52/144

[58] Field of Search ..... 181/210, 284, 181/286, 287, 290, 295; 52/144

[56] References Cited

U.S. PATENT DOCUMENTS

| | | | |
|---|---|---|---|
| 3,667,175 | 6/1972 | Bjorksten | 52/144 |
| 3,936,035 | 2/1976 | Wemar et al. | 181/210 |
| 5,329,073 | 7/1994 | Shono et al. | 181/210 |

FOREIGN PATENT DOCUMENTS

| | | |
|---|---|---|
| 27 44 335 | 4/1979 | Germany . |
| 34 06 663 | 9/1985 | Germany . |
| 90 03367 | 4/1992 | Sweden . |

*Primary Examiner*—Khanh Dang
*Attorney, Agent, or Firm*—Young & Thompson

[57] ABSTRACT

A noise barrier for use especially outdoors or by roadways. The barrier comprises two main components, namely a relatively light sound-insulating plane and a grating-like part which constitutes the outward appearance of the noise barrier. The sound-insulating plane is a carpet-like part disposed inside the grating-like part and hangs freely therefrom or from another support frame. The grating-like part screens the sound-insulating plane from view, and is designed such that neither accuracy nor an immobile foundation is needed in the mounting of the noise barrier in order to make its outward appearance acceptable. If the grating is made for example spiral and the plane folded or rolled up, the construction can be arranged in a small room for transport and unrolled when it is mounted. The noise barrier can also function as a crash wall.

9 Claims, 1 Drawing Sheet

NOISE BARRIER

FIELD OF THE INVENTION

The present invention relates to a noise barrier, which is used mostly by the side of roadways to reduce traffic noise and air pollution.

BACKGROUND OF INVENTION

Noise reduction in itself by building noise barriers is not a difficult problem in noise pollution technology. There are different fence-like solutions and noise reduction embankments in use. Because a part of the sound bends over the barrier, it is no use building one, which in very sound-insulating, about 20 dB is enough. For example, a tight carpet weighing about 5–10 kg reaches this level. Present solutions are heavier than necessary, more expensive and often unsatisfying in appearance. Embankments with vegetation are considered visually more natural, but they take often too much space and require expensive foundation reinforcement on a weak ground.

SUMMARY OF INVENTION

The advantage of the invention is a construction which being light and airy is suited for its role and does not require either accuracy or immobile foundations when it is mounted. The construction does not get dirty as easily as present fences, and it is easy to manage. The construction can also function as a crash wall.

The basic idea of the invention is to divide the noise barrier into a rather light carpet-like, mainly hanging noise reduction plane and a grating-like part which covers the plane and provides the visual appearance. The plane can be supported by the grating-like part or a separate frame. As it is screened from view, neither accuracy nor immobile foundations are necessary when it is mounted. It can be a tight, weatherproof carpet weighing about 5–10 kg/m$^2$, covered with stone chips or camouflaged. The lower end of the carpet bends partly over the ground or it can be 200 mm off the ground and the noise reduction is still achieved. The visual idea of the grating-like part can be compared to a sparse latticework of a suspended ceiling: when one looks at it perpendicularly one can see pack discharges and things like that behind it but when one looks at it diagonally it forms a ceiling surface. The other basis for the appearance of the grating part is that it is "hedge-like". Just like a hedge is visually acceptable as "inaccurate", the grating part is also made such that neither accuracy nor immobile foundations are necessary when it is mounted. It can stand on the ground without foundations. Soil acting as a weight may be placed on its basal part lying against the ground. When the grating part is made for example spiral and the noise reduction plane folded or rolled up, the construction can be arranged in a small room for transport, and unrolled when it is mounted. The mounting can be done with a mobile crane from a roadway.

BRIEF DESCRIPTION OF THE DRAWINGS

The invention will now be described with reference to the drawings in which.

DETAILED DESCRIPTION OF THE INVENTION

Figure 1:
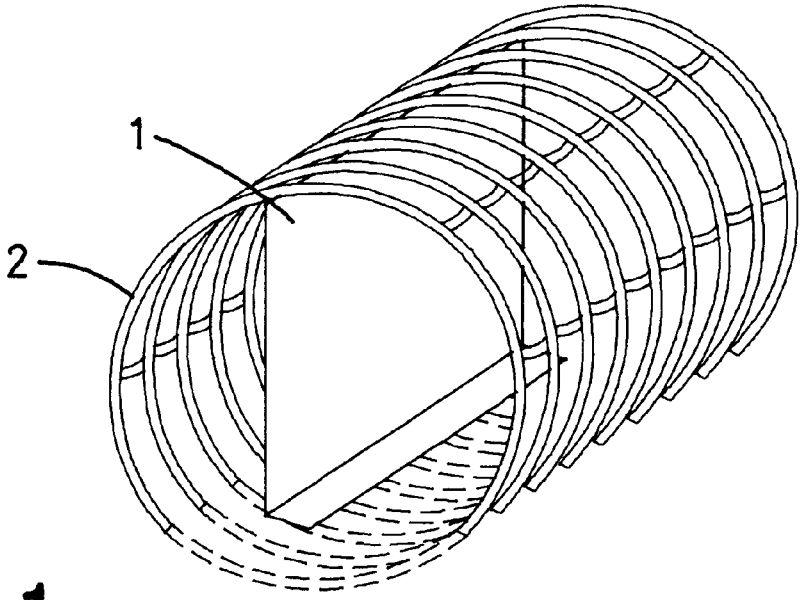
FIG. 1 depicts a noise barrier according to a first embodiment of the present invention.

With reference to FIG. 1, the actual noise reduction plane (1) is located inside a spiral grating frame (2). The material of the grating can be for example wood, metal or plastic. The transversely flat form increases the capability of the grating to screen the plane from view. The upper edge of the grating is round whereupon inaccuracy in mounting and movements caused by the frost heaving action of the soil do not worsen its appearance. Soil is provided as a weight on the basal part of the grating frame. The lower edge of the hanging noise reduction carpet can bend against the ground or hang a bit off the ground. The carpet is a better noise barrier than a stiff sheet of the same weight. The design of the grating in the figures is only one of several alternatives of the principle of the invention. It is possible to improve the design of the noise barrier depicted in FIG. 1, including the appearance of the noise reduction carpet. For example, it can include stone chips which increase the weight of the carpet or be camouflaged in the army way. The construction works well with vegetation, the introduction of which makes the appearance even better.

Figure 2:
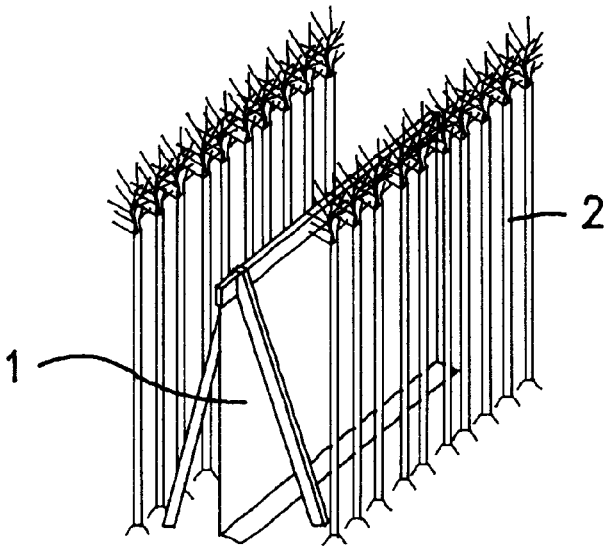
FIG. 2 depicts a noise barrier according to a second embodiment of the present invention.

With reference to FIG. 2, the noise reduction plane (1) is supported by a triangular frame and the covering grating (2) lies apart from it. The bars of the grating in the figure are slender willow trunks or the like that, penetrate the soil in an upright position. They are green in the summer and their densely planted trunks form a covering grating also in the winter. For example, the bars could as well be dead, round trees in a slightly oblique position, coupled together horizontally, leaning against the triangular frame. The entire construction does not require accuracy.

I claim:

1. A noise barrier for use on the side of a roadway, comprising:

a carpet-like sound-insulating plane hanging freely from a support structure;

a grating part which surrounds and covers said sound-insulating plane;

said grating part constituting the outward appearance of the noise barrier, and being structured and arranged to support the sound-insulating plane;

said grating part screening the sound-insulating plane from view, and resting directly on the ground without a separate foundation.

2. The noise barrier according to claim 1, wherein the grating part has the shape of a bush, and the sound-insulating plane has an elastic lower edge such that said lower edge can bend against the ground or hang a bit off the ground.

3. The noise barrier according to claim 1, wherein the grating part is rollable and spiral shaped, and the sound-insulating plane is rollable, whereby the barrier can be arranged in a small room for transport and unrolled when erected.

4. The noise barrier according to claim 1, wherein the grating part consists of a line of living willow trunks adapted to penetrate the soil in front of the sound-insulating plane, supported by a separate frame, such that the grating part is green in the summer.

5. The noise barrier according to claim 1, wherein the grating part consists of a louvre carpet which is mounted in front of the sound-insulating plane, supported by a separate frame, and which leans diagonally against the sound-insulating plane.

6. The noise barrier according to claim 1, wherein the grating part has a triangular cross-sectional surface with round angles and an apex pointing upwards, and wherein in use, said grating part is placed on a bank, close to the roadway with a removable weight on its basal part, whereby the height of the noise barrier can be arranged as low as possible, said noise barrier also functioning as a crash wall and a roadside marking.

7. The noise barrier according to claim 1, wherein the carpet-like sound-insulating plane is elastic and is one meter high so that said sound-insulating plane is bendable and allows snow to go under it when the roadway is plowed; said noise barrier being made of waste rubber and being reinforced with horizontal cables for use as a crash wall.

8. The noise barrier according to claim 1, wherein the grating part includes evergreen vegetation on both sides.

9. The noise barrier according to claim 1, wherein the noise barrier is transportable and removable.

* * * * *

UNITED STATES PATENT AND TRADEMARK OFFICE

CERTIFICATE OF CORRECTION

PATENT NO. : 5,902,969

DATED : May 11, 1999

INVENTOR(S) : Harto HELPINEN

It is certified that error appears in the above-indentified patent and that said Letters Patent is hereby corrected as shown below:

On the title page, between Item [22] and Item [30] insert:

--[86] PCT No.: PCT/FI96/00132

§ 371 Date: Sep. 15, 1997

§ 102(e) Date: Sep. 15, 1997

[87] PCT Pub. No.: WO96/28614

PCT Pub. Date: Sep. 19, 1996--.

Signed and Sealed this

Twenty-eighth Day of December, 1999

*Attest:*

Q. TODD DICKINSON

*Attesting Officer*

*Acting Commissioner of Patents and Trademarks*